United States Patent [19]

Juillard et al.

[11] 3,988,881

[45] Nov. 2, 1976

[54] DEVICE FOR FEEDING FIBERS TO UNITS FOR SPINNING FREED FIBERS

[75] Inventors: Yves Juillard; Jacques Le Chatelier, both of Mulhouse, France

[73] Assignee: Societe Alsacienne de Constructions Mecaniques de Mulhouse, Mulhouse Cedex, France

[22] Filed: July 8, 1975

[21] Appl. No.: 593,943

[30] Foreign Application Priority Data

July 9, 1974 France ..... 74.23763

[52] U.S. Cl. ..... 57/58.91; 19/258; 57/36

[51] Int. Cl.[2] ..... D01H 1/12

[58] Field of Search ..... 57/58.91, 58.95, 36, 57/90; 19/97, 105, 236, 258; 29/121 R, 121 H, 125

[56] References Cited

UNITED STATES PATENTS

| | | | |
|---|---|---|---|
| 2,925,628 | 2/1960 | Boer | 19/258 |
| 2,926,483 | 3/1960 | Keeler et al. | 57/58.95 |
| 3,685,270 | 8/1972 | Bartling | 57/58.91 X |

*Primary Examiner*—Richard C. Queisser
*Assistant Examiner*—Charles Gorenstein
*Attorney, Agent, or Firm*—Holman & Stern

[57] ABSTRACT

The invention relates to devices for supplying fibers to a unit for spinning loose or free fibers. Such a device according to the invention comprises a feeding device including means for holding back a sliver of fibers and a fiber-separating device disposed in a hollow enclosure and constituted by a rotary drum, the surface of which is made up by elements of narrow fiber-separating ridges which each extend in a circumferential direction in a plane perpendicular to the drum axis over only a part of the drum periphery; two of said elements successive in the axial direction are angularly staggered while narrow and deep grooves separate in the axial direction at least a part of said ridge elements from one another; the invention is generally applicable to feeding devices of spinning units of free or loosened fibers of all kinds.

17 Claims, 11 Drawing Figures

DEVICE FOR FEEDING FIBERS TO UNITS FOR SPINNING FREED FIBERS

FIELD OF THE INVENTION

The invention relates to devices for feeding fibres to units for spinning freed fibres.

BACKGROUND OF THE INVENTION

These devices comprise means for holding back a sliver of fibres and a fibre-separating device capable of separating the fibres of the sliver from one another on leaving said means for holding back the sliver, this fibre-separating device being arranged in an enclosure at a reduced pressure, connected through a suitable conduit to inlet of the spinning unit, for example of the rotor type. The part played by the fibre-separating device is the changing of a sliver of fibres more or less adhering together into fibres separated from one another which are flung into the flow of air intended to carry them into the spinning unit.

Up until now, two types of fibre-separating devices have been used, namely; the fibre separator with doffer and the fibre separator with drafting.

In the fibre separator with doffer, the sliver of fibres is held back by a device comprising a feed roller controlling the feed of fibres, the roller being combed by a porcupine drum which separates the mass of fibres not held back by the feed device in order to throw them, by centrifugal and pneumatic effects, into the flow of air which flows towards the spinning unit.

In the fibre separator with drafting, there is ensured by a very high rate of drafting, hackling of the sliver in such a way that the latter enters into the flow of air with a structure such that the cohesion between the fibres is sufficiently weak for the fibres to be detachable from one another when they reach the flow of air which carries them along into the spinning unit.

Now, in the actual state of the art, it is considered that neither one of these two types of fibre separator gives complete satisfaction. In fact, the combing drum is more efficient than the fibre-separator with drafting for the working of the short fibres and this advantage is all the more marked the shorter are the fibres, this because of the extended division of the mass of fibres supplied. On the contrary, for the fibres of a length of from 40 to 60 mm and more, the fibres are worked by drafting in a manner less coarse than by combing, which reduces to the minimum the breaking of fibres due to the positive extraction of the fibres by the drafting rollers. On the other hand, in the fibre separator with drafing, a high pressure arises in the vicinity of the drafting rollers, especially if the latter rotate at high speed, which is often sought after, and this high pressure brings about a detrimental lateral spreading of the fibres of which part thus breaks free of the rollers.

SUMMARY AND OBJECTS OF THE INVENTION

The object of the invention is to bring into being a feeding device with a fibre separator derived from fibre separators with drafting, which combines the advantages of the two types hereinbefore recalled to mind without introducing the disadvantages thereof.

To this end, in the fibre-separating device according to the invention, the drafting roller is constituted by a rotary drum which is generally cylindrical in shape and whereof the surface is made up of narrow fibre-separating ridge elements which each extend, in the circumferential direction in a plane perpendicular to the drum axis, only over a fraction of the periphery of said drum while two fibre-separating ridge elements successive in the axial direction are angularly staggered and narrow and deep grooves separate in the axial direction at least a portion of said ridge elements from one another.

Such a device provides the advantage of fibre separators with doffer, as the rotary drum may be driven at a high circumferential speed while effecting less coarse work than a hackler. It also provides the advantages of the fibre separator with drafting, since its drum may be compared with a large diameter drafting fluted roller with positive extraction of the fibres, without coarse action and with the minimum of breakage of fibres, while providing the passage required for the flow of air necessary to the carrying along of the fibres thanks to the presence of the deep grooves between the ridge elements. Positive and punctual extraction of the fibres may then be carried out with a very fine separation, and with a high yield like that of a hackler without risk of high pressure at the intake side with lateral spreading of the fibres thanks to its increased receptivity to the flow of air. Its high fineness enables a very finely-divided separation of fibres as is the case with a fibre separator, with hackler.

The aforesaid separation facilitates the passage of the joins on the slivers supplied and, on the other hand enables, as is hereinafter described, control of the advance of the supplied sliver by means of a single pair of suitable aprons or rollers by doing away with the predrafting zones existing in drafting devices of the usual type.

In preferred embodiments, the fibre-separating ridges are made up by the edges of circular parts of the periphery of disks fixed on a shaft and whereof the periphery is, at least in part, of circular shape. According to the particular structure which may be given to these disks, they will be placed one after another on the shaft either directly against one another or alternatingly with intermediate washer-like distance pieces.

The invention will be better understood on reading the description which is about to follow and on examining the accompanying drawings which show, by way of non-limiting examples, a few embodiments of fibre-separating devices according to the invention. In these drawings:

DESCRIPTION OF PREFERRED EMBODIMENTS

Figure 1:
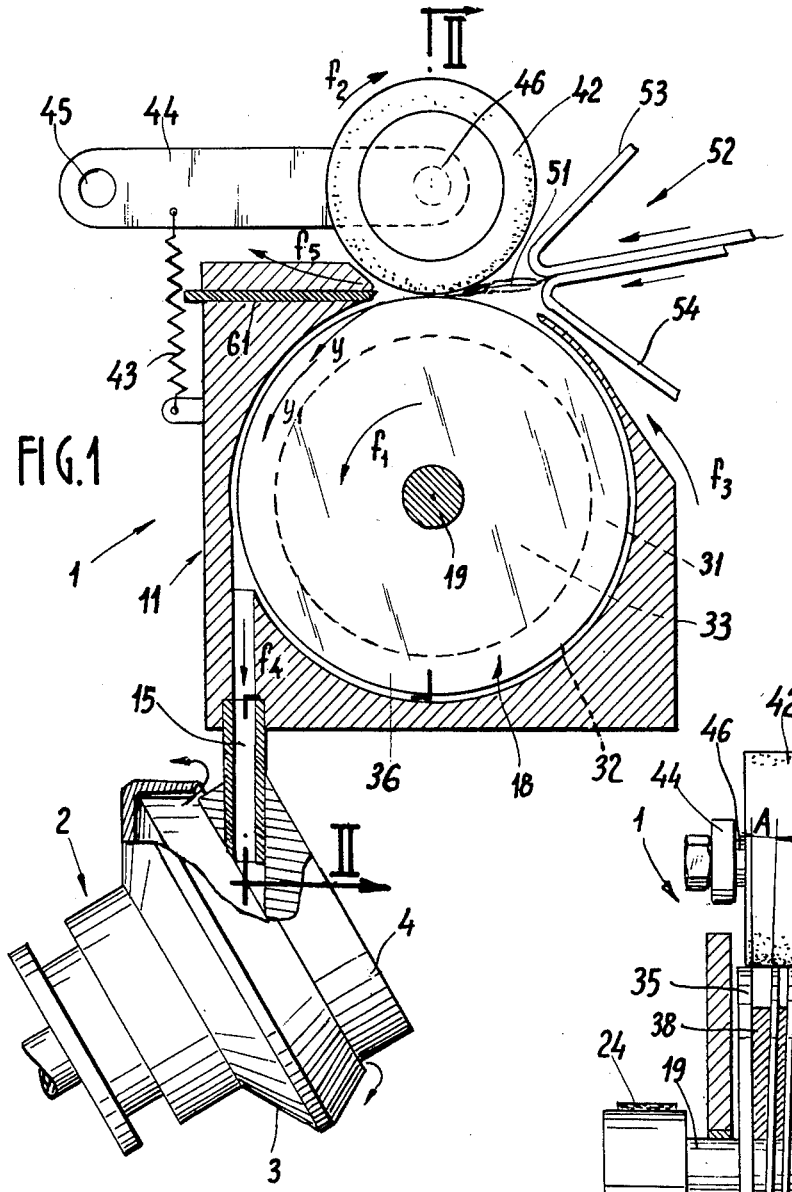
FIG. 1 is a sectional view, taken along the line I—I of FIG. 2 of a first embodiment of a device for supplying fibres comprising a fibre separator according to the invention.
Figure 2:
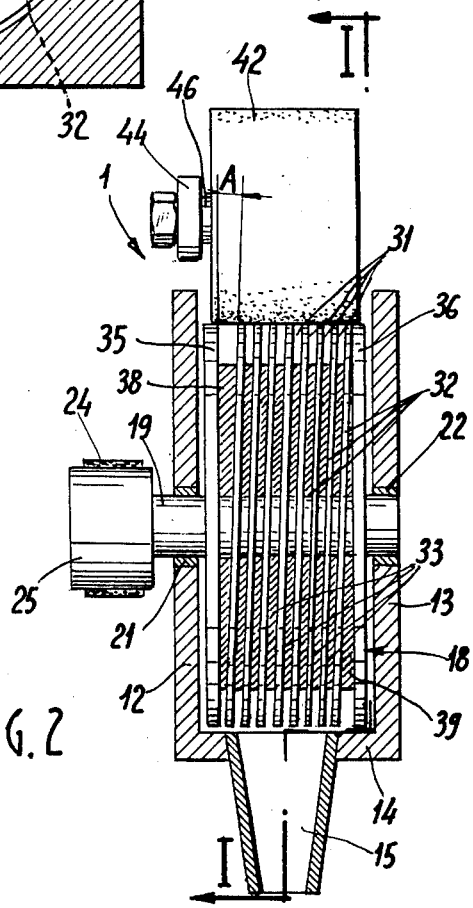
FIG. 2 is a section taken along the line II—II of FIG. 1.

The feeding device, denoted in its entirety by the reference numeral 1 in FIGS. 1 and 2, is intended to supply with freed fibres a spinning unit 2 of which there is schematically shown on the drawing only the rotor 3 and the fixed cover 4.

The feeding device 1 comprises a cabinet 11 with two sides 12, 13 and a bottom 14 provided with a nozzle 15 serving as direct supply pipe of the freed fibres into the rotor 3 of the spinning unit 2 through the fixed cover 4.

In the interior of the cabinet 11, there is mounted a rotary drum 18, the shaft 19 of which is journalled in two collars forming bearings 21, 22 fixed, respectively, in the two sides 12, 13.

The drum is rotated by suitable conventional means, for example, through the intermediary of a belt transmission 24 which extends about a pulley 25 fixed on the shaft 19 of the drum.

The drum 18 is the fibre-separating member. It is generally cylindrical in shape and its surface presents narrow, close, slanting, fibre-separating ridges made up, in this example, by the faces of flat annular disks 32, for example, of sheet metal, fitted one after another and locked on the shaft 19 alternately with parallel-faced washer-like distance pieces 33 between two check plates 35, 36 also with parallel faces and against the inner surfaces of which bear, respectively, to outer washer-like distance pieces 38, 39 in the form of wedges the inclined flat faces of which are parallel to one another, so that all of the disks 32 are parallel to one another and all subtend a small acute angle *a* with a plane transverse to the drum axis. By way of modification, the outer washers 38, 39 could also have parallel faces and the inner faces of the two check plates be slanting.

The outer diameter of the washer-like distance pieces 33 is distinctly smaller than the external diameter of the disks 32 so as to form, between the marginal parts of two successive disks, deep grooves 31 which make the drum pervious to the air.

The drum, i.e. the edge surfaces of the disks 32 and, preferably also, the edge surfaces of the two check plates 35, 36 are trued perfectly cylindrical, to one diameter. Against the upper generating surface of the drum 18 there bears a pressure roller 42, preferably provided with a facing of elastomeric material and resiliently urged against the drum 18, for example, by a spring 43 which exerts a pull on an arm 44 one end of which can pivot on a fixed spindle 45, while its other end supports the spindle 46 of said pressure roller 42.

The drum 18 is rotatably driven in the direction of the arrow $F_1$ and the pressure roller 42, pressed on to the drum, thus rotates in the opposite direction, i.e. that of the arrow $F_2$. The sliver to be divided is introduced from the upstream side of the nip generatrix A of the drum 18 and of the pressure roller 42, for example, by a system of aprons 52 comprising an upper apron 53 and a lower apron 54, of any suitable conventional kind.

The operation is as follows:

Given that the disks 32 are fixed slantingly on the shaft 19, their edge surfaces, which make up the fibre-separating ridges, do not extend in any single plane perpendicular to the drum axis except over a part only of the periphery of said drum. In other words, the points of contact between the fibre-separating ridges and the elastomeric pressure roller are continually displaced, in a reciprocating motion, in the axial direction. Moreover, the slanting of the disks and their spacing apart from one another are selected such that, in each theoretical transverse plane of the drum, there is always at least one fibre-separating ridge part.

The sliver 51, introduced by the aprons 52, is drawn by the rotating drum 18 by gripping against the pressure roller 42. There are then produced almost regular extraction of the fibres at the points A of contact of the edge of each of the disks 32 and of the cylindrical surface of the pressure roller 42 faced with elastomeric material. A reduced pressure prevails in the interior of the cabinet 11 of the fibre separator, under the action of the movement of the rotor 3 of the spinning unit 2, supplemented possibly by additional means for circulating air; there is then produced in the whole a flow of air which enters the cabinet 11 upstream of the nip generatrix A, as indicated by the arrow $F_3$. This air flow, the impulsion of which is assisted by the rotation of the drum 18 in the direction of the arrow $F_1$, easily finds its way between the disks 32 of the drum, in the annular grooves 31 which provide for passage of the air within the drum periphery, then this flow of air passes into the nozzle 15, as indicated by the arrow *f*4, while carrying the individualized fibres along therewith into the rotor 3.

With a high linear speed of the fibre-separating drum 18, there is effected a positive extraction of fibres as in a fibre separated with drafting, but at a much higher speed, i.e. of the order of that which can be used with combing drums, which has been made possible by the fact that on account of the receptiveness of the fibre-separating drum 18 to the flow of air, there is no longer excess pressure due to the speed and to the proximity of the surface of the drafting rollers, as is produced in fibre separators with drafting with a lateral spread of the mass of the fibres. Moreover, given that each fibre is drawn by the fibre-separating drum, by one of its ends, there is no risk of it being shortened as in a fibre separator with doffer.

In FIG. 1, at the downstream side of the nip generatrix, there is shown a knife 61 mounted in such a manner that the distance from its edge to the nip generatrix is adjustable as desired. In this way, there is brought about an efficient separation of the impurities with little lift in the air relative to their volume, such impurities being ejected under the effect of the centrifugal forces as indicated by the arrow F5, while the fibres follow the annular grooves 31 of the fibre-separating drum on account of the predominant effect of the reduced pressure before being carried along towards the spinning rotor by the nozzle 15.

Figure 3:
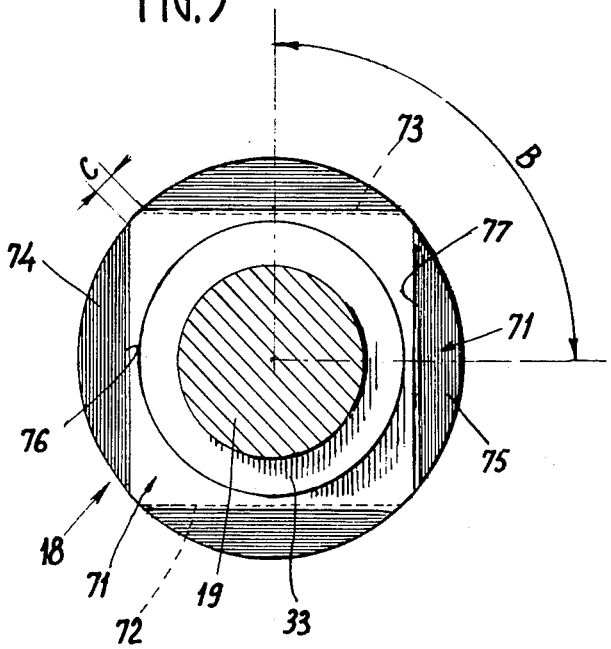
FIG. 3 is an end view of another embodiment of fibre-separating drum according to the invention.
Figure 4:
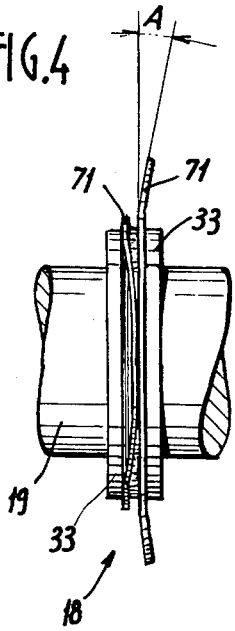
FIG. 4 is a partial elevational view corresponding to FIG. 3.

In FIGS. 3 and 4, there are shown only two disks of a modification in the structure of the fibre-separating drum 18, in which the thin annular disks 71 smooth and circular, have two segments 72, 73 cut off along two parallel chords denoted by the same reference numerals 72, 73 while the remaining active segments 74 of each disk are bent laterally along another chord 76, 77 respectively, parallel to, but shorter than, the chords which subtend said active segments, so as to form with a plane perpendicular to the drum axis, an actue angle A (see especially FIG. 4).

The dimensions of the various parts of the disks and the distance apart of the disks are selected such that, in each theoretical transverse plane of the fibre-separating drum, there is always at least one point of the circular active edge surfaces of the disks, as can be seen in FIG. 4.

All of the disks 71 are identical and, in the example, the two active segments 74, 75 of one and the same disk are bent to the same side of said disk and, moreover, the bends of the active segments of all of the disks of the drum are inclined in the same sense. Besides, the disks are angularly displaced successively with respect to one another by an angle B such that there is a partial overlapping C of the active segments of the various disks which make up the drum 18. Here again, the general surface of the drum, i.e., the edge surfaces of said disks are trued to be perfectly cylindrical. The drum of this embodiment operates substantially under the same conditions as that of the embodiment of FIGS. 1 and 2.

In a modification, the cut-off segments 72, 73 could pass through the points of the active segments 74, 75 independently of the amount of the overlap C desired.

Figure 5:
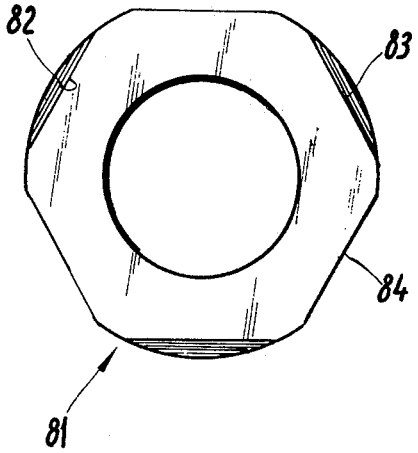
FIG. 5 is a front view of a modification of a disk of the device of FIG. 3.

The number of the active segments of each disk is not necessarily two, and could be greater than this number. By way of example, there is shown in FIG. 5 a disk 81 with three active segments 82, 83, 84 respectively, distributed uniformly over the periphery of the disk and, each having the same characteristics as those of the active segments of the disks in FIG. 3.

Figure 6:
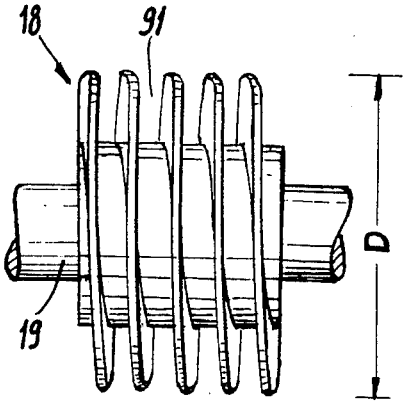
FIG. 6 is an elevational view of another embodiment of the fibre-separating drum.

In FIG. 6, there is shown another modification which differs from the embodiments of FIGS. 1 to 4 by virtue of the fact that the grooves are no longer formed by spaces between the side-by-side sheet metal disks, but by deep recesses 91 helically cut in the cylindrical surface of a solid drum of external diameter D. The grooves thus formed determine together the fibre-separating ridges; they may be at a single thread or else several threads, and form fibre-separating ridges corresponding to one thread or several threads. The operation of the fibre-separating drum is always substantially the same, that is to say that the narrow fibre-separating ridges constituted, in this example, by the outer surfaces of the threads, form with the continuous cylindrical surface of the upper pressure roller 42, nip points which are constantly displaced in the axial direction during the rotation of the fibre-separating drum 18.

Figure 7:
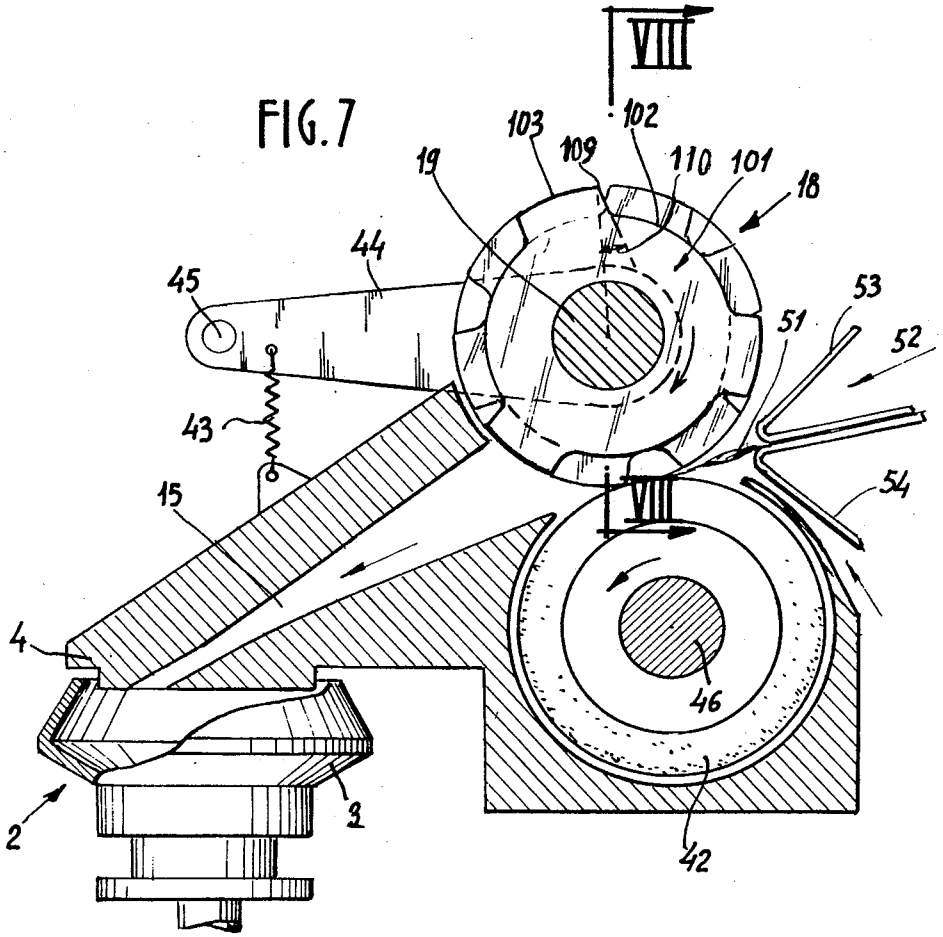
FIG. 7 shows, in elevation with parts omitted, a modification of the supplying device of FIG. 1.
Figure 8:
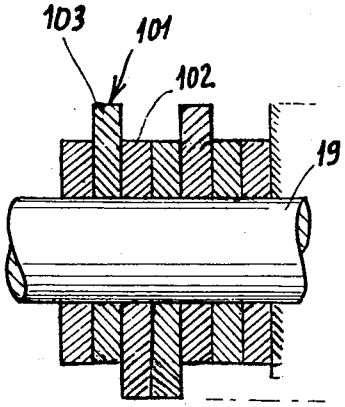
FIG. 8 is a partial section taken along the line VIII—VIII of FIG. 7.

In FIG. 7, there is shown another embodiment which differs from that of FIG. 1, on the one hand by the inversion of the positions of the fibre-separating drum and of the pressure roller, and on the other hand by the structure of said fibre-separating drum.

The fibre-separating drum 18 is constituted by a side-by-side arrangement of disks 101 of generally circular shape fixed on the shaft 19 mounted for rotation in one end of the arm 44 which pivots, through its other end, on the spindle 45 and which is subjected to the action of the return spring 43, while the roller 42 faced with elastomeric material is supported by the shaft 46 which, in this example, is the driving shaft. Opposite the upstream side of the contact generatrix A of the fibre-separating drum and of the pressure cylinder, is the pipe 15 for supplying the fibres into the spinning unit 2.

Each disk 101 of the fibre-separating drum has in its periphery a certain number of recesses 102 leaving between them fibre-separating ridges 103 in the form of arms of a circle on the periphery of the disk. In the example, the number of recesses and, consequently, of fibre-separating ridges, is equal to three, but it could be of any other desired amount.

Figure 9:
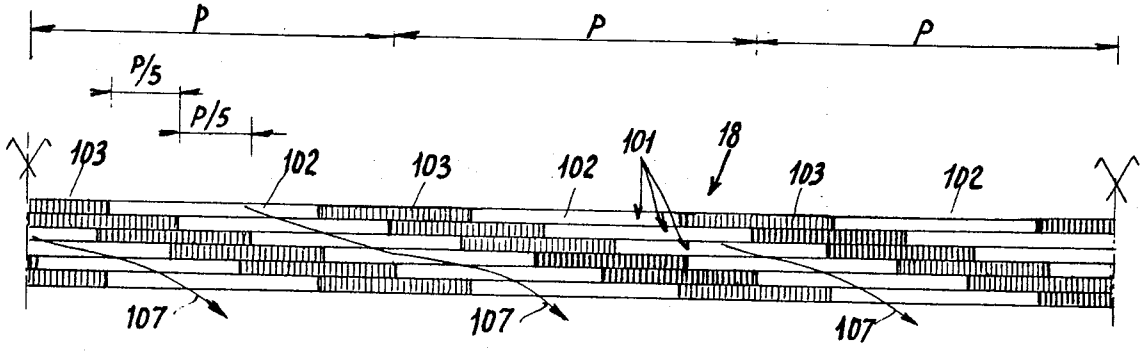
FIGS. 9 and 10 are two developed views of the fibre-separating drum of FIGS. 7 and 8 illustrating two different arrangements in the relative angular adjustment of the fibre-separating disks.

The fibre-separating disks 101 are angularly displaced successively by each relative to the others by a certain amount, in accordance with any desired law. Thus, in the example shown in FIG. 9, which shows the development of a part of the cylindrical surface of the fibre-separating drum 18, each disk 101 is angularly displaced, relative to the preceding disk, by an amount equal to a fifth of the pitch of the fibre-separating ridges. There are thus formed adjacent the cylindrical surface of the fibre-separating drum channels of helical form in which the flow of air for carrying along the fibres can circulate without detrimental resistance.

Figure 10:
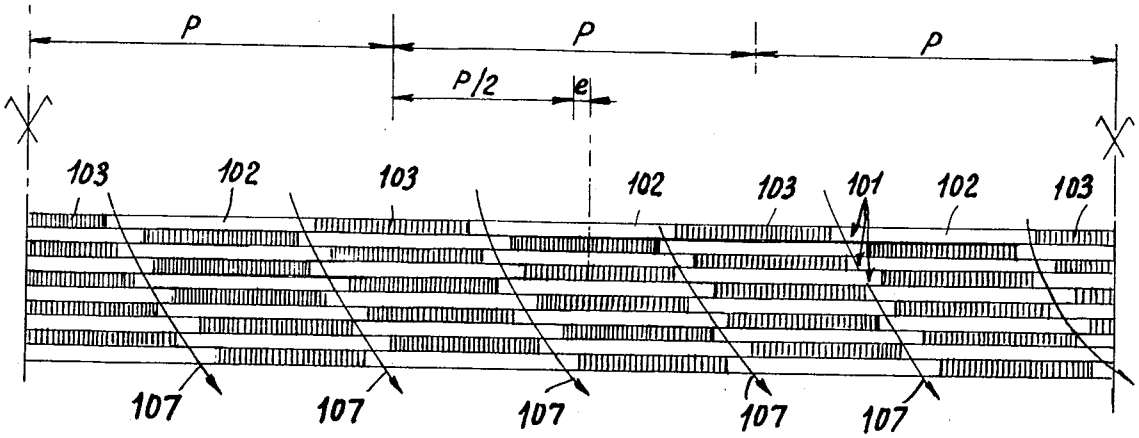

With a view to leaving a gap without possible gripping of fibres on both sides of any fibre-separating ridge, in another arrangement of which the development is shown in FIG. 10, the angular displacement of two successive disks is equal to half of the pitch increased by a small amount *e* less than half of the pitch *p*. In order that helical passages are always contrived for the flow of air, it is necessary, in this arrangement, that the circumferential length of the fibre-separating ridges 103 be less than the circumferential length of the recesses 102 which separate two successive fibre-separating ridges.

It should be noted that for these modifications, it is preferable that at the junction point 109, the angle 110 formed by the junction of the part 102 with the arc 103 is of the order of 45° to 60° to improve the rapidity of evacuation of the fibres.

Figure 11:
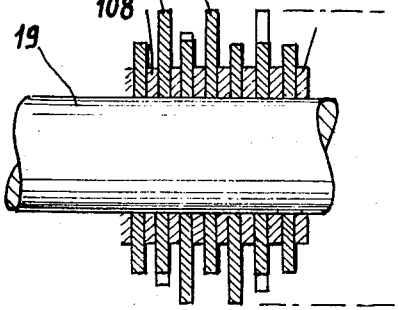
FIG. 11 is a modificaton of FIG. 8.

In FIG. 11, there is shown a modification of the FIG. 6 arrangement, differing from the latter only by the fact that the fibre-separating disks 101 are separated from one another by washer-like distance pieces 108. In this embodiment, it is preferable also to displace the various disks angularly relative to one another in accordance with any desired law. In the planes of the washer-like distance pieces 108, no fibre can be nipped at the contact generator A, while in all of the embodiments of FIGS. 1 to 10, there is always a fibre-separating ridge element, at least, in any theoretical transverse plane of the fibre-separating drum.

Of course, the invention is not limited to the embodiments described and shown; it is capable of numerous modifications accessible to the technician, according to the applications in view and without thereby departing from the scope of the invention.

Thus, for example, the structural details of the whole and especially, of the individual disks which make up the fibre-separating drum, would be different than those shown, in the shape of the disks as well as in the manner in which the active segments are bent and the disks angularly displaced in relation to one another.

We claim:

1. A device for feeding fibres to an open-end spinning device comprising retaining means for retaining a sliver of fibres and having an outlet; a rotary drafting drum located at said outlet from said retaining means; a pressure roller, said drafting drum rolling against said pressure roller for separating the fibres of the sliver from one another; means for generating a gaseous current flowing from said outlet for carrying the fibres toward said spinning unit; said drafting drum comprising a rotary shaft having an axis, a set of disks stacked on said shaft, at least one portion of each disk having a smooth peripheral edge which forms a fibre-separating ridge element extending in a circumferential direction in a plane perpendicular to said axis over only part of the periphery of said drum, two successive fibre-separating elements being distant from one another in an axial direction by an internal to form narrow deep grooves for the passage of said gaseous current around said drum, the axial width of said interval being small enough for at least one fibre-separating ridge element to be present in any geometrical plane perpendicular to said axis along the axial length of the set of disks.

2. Device according to claim 1, characterised in that the disks are disposed face to face directly against one another on the shaft in planes perpendicular to the axis of said shaft.

3. Device according to claim 1, characterised in that washer-like distance pieces of external diameter less than that of the disks are interposed between said disks.

4. Device according to claim 3, characterised in that the disks are smooth complete planar circles fixed slantingly on the shaft in parallel planes.

5. Device according to claim 1, characterised in that the disks have peripheral notches and are angularly displaced relative to one another.

6. Device according to claim 5, characterised in that the angular displacements of the successive disks are less than half the circumferential pitch of the peripheral ridges, are equal and are in the same circumferential sense.

7. Device according to claim 5, characterised in that the angular displacements of the successive disks are equal to half the circumferential pitch of the peripheral ridges increased by an increment less than half said pitch.

8. Device according to claim 1, characterised in that the disks are smooth and are locked, with washer-like distance pieces in planes normal to the drum axis, each disk having several sections cut off along chords, while the remaining active segments are bent laterally along other chords so as to form an acute angle with a plane perpendicular to the drum axis, the fibre-separating ridge elements being constituted by the edge of said active segments.

9. Device according to claim 8, characterised in that the bend of each active segment is made along a chord parallel to but shorter than that which the arc of said active segment subtends.

10. Device according to claim 8, characterised in that all of the active segments of one and the same disk are bent to the same side of the disk.

11. Device according to claim 10, characterised in that the active segments of all of the disks of the drum are bent to the same side.

12. Device according to claim 8, characterised in that the disks are angularly displaced successively relative to one another through an angle such that there is partial circumferential overlapping of the active segments of the various disks of one and the same drum.

13. Device according to claim 8, characterised in that the angular displacements of the successive disks are less than one half the pitch of the peripheral ridge elements, are equal and are in the same circumferential sense.

14. Device according to claim 8, charactised in that the angular displacement of the successive disks are equal to half the circumferential pitch of the ridges elements increased by an increment less than half said pitch.

15. Device according to claim 5, characterised in that the circumferential length of the fibre-separating ridge elements is less than the length of the grooves which separate two successive fibre-separating ridge elements in the circumferential direction.

16. Device according to claim 1, characterised in that the angular displacements of the successive disks are equal to a third of the pitch of the peripheral ridge elements increased by an increment less than a third of the pitch.

17. Device according to claim 5, characterised in that, on each aforesaid disk, the line of junction between the end of a fibre-separating ridge element and the adjacent peripheral groove is inclined by about 45° to 60° relative to the disk radius passing through said end.

* * * * *